United States Patent [19]

Feldman

[11] 4,332,318

[45] Jun. 1, 1982

[54] STORAGE VIAL FOR SOFT CONTACT LENSES

[76] Inventor: Michael A. Feldman, 864 Glenridge Ave., North Woodmere, N.Y. 11598

[21] Appl. No.: 115,711

[22] Filed: Jan. 28, 1980

[51] Int. Cl.[3] ..... A61F 9/00; B65D 85/00

[52] U.S. Cl. ..... 206/5.1; 294/1 CA; 134/117; 215/227

[58] Field of Search ..... 206/5.1; 215/227; 134/117, 143, 166 R; 294/1 CA, 64 R

[56] References Cited

U.S. PATENT DOCUMENTS

| | | | |
|---|---|---|---|
| 1,740,717 | 12/1929 | Waite | 215/227 |
| 3,091,928 | 5/1963 | Leonardos | 294/1 CA |
| 3,413,975 | 12/1968 | Hein | 215/227 |
| 3,647,380 | 3/1972 | Middleton | 294/1 CA |
| 3,964,926 | 6/1976 | Westphal | 206/5.1 |
| 4,091,917 | 5/1978 | Clawson | 206/5.1 |
| 4,167,283 | 9/1979 | Feldman | 294/1 CA |

FOREIGN PATENT DOCUMENTS

| | | | |
|---|---|---|---|
| 1281646 | 10/1968 | Fed. Rep. of Germany | 294/1 CA |

*Primary Examiner*—Herbert F. Ross
*Attorney, Agent, or Firm*—Berger & Palmer

[57] ABSTRACT

A vial for storing soft contact lenses is disclosed in which the vial contains a cap having a concave seating surface connected in the cap. When the vial is stored upside down, the soft lens migrates to be seated in the seating surface in the cap, and when the soft lens is to be removed from the vial, the vial is merely turned right-side up, with the lens adhering to the seating means and being removed from the vial when the cap is removed from the vial.

11 Claims, 6 Drawing Figures

STORAGE VIAL FOR SOFT CONTACT LENSES

STATEMENT OF PRIOR ART

The prior art is applicant's own prior United States Patent entitled Apparatus For Applying a Soft Contact Lens U.S. Pat. No. 4,167,283 as well as the publically sold widely utilized Bausch & Lomb type soft lens vial. This vial is comprised of a bottle and rubber cap, with the cap secured to the vial in fluid-tight relationship by a metal ring. The prior art vial is stored in the normal right-side up position, and the contact lens is removed from the vial with a tweezers, as set forth in this patent application. The cap for the vial is formed of a rubber or resilient type material, and has a concavity formed therein with the concavity being oppositely directed to the bottom of the bottle. The concave shape for the cap of the vial has no relationship to the shape of the contact lens stored, and in fact, the concavity of the cap is much greater than any contact lens. The range of radii of curvature for soft-contact lenses is well known in the art to be 7.0–11.0 mm. This is seen in the Journal of the American Optometric Association, March 1979 issue on page 296. The reasons for this is that the cap is a standard manufacture for vials in which syringes are used, and the cap has the concave surface in order to eliminate as much of the rubber in the cap as possible, yet permit the insertion of the hypodermic needle or the like. Therefore, the concavity of the cap in the prior art vial is much greater than that of the contact lens stored therein, and there is insufficient surface presented between the cap when turned upside down and the stored contact lens to permit the contact lens to adhere to the cap while being removed from the bottle. This is due to the fact that the soft lens might adhere to the rim of the prior art cap but not in a centered portion. Therefore, the lens will also stick to the side of the bottle and will not come out of the bottle as the cap is removed.

The necks of standard vials for storing soft contact lenses are generally about 13.0 mm. The average contact lenses stored therein is greater than 13.0 mm., preventing them from passing through the neck to be seated in a cup like structure.

BACKGROUND OF THE INVENTION

This invention relates to a new apparatus and method for storing and retrieving soft contact lenses.

Conventionally, soft contact lenses are stored in vials in a storage solution. The soft contact lens migrates to the bottom of the vial and when removed, a tweezer-like tool is often employed. This tool is frequently contaminated, because it is allowed to lay on open surfaces exposed to air and is rarely washed or sterilized. Further, removal of the soft contact lens with the tweezer-type tool is often difficult, which may result in damage to the soft lens.

An object of this invention is to provide an improved storage package for storing soft contact lenses, while facilitating their removal from the stored container.

Yet another object of this invention is to enhance the sterility of the process of removing soft contact lenses from their stored containers.

Another object of this invention is to provide such a storage container which is adapted to be used for contact lenses of varying sizes.

Still another object of this invention is to provide such a storage container which easily enhances the ability to remove the stored lens from the container without damage to the lens.

Another object of this invention is to provide such a storage container in which the construction is designed to ensure that the soft contact lens descends to be seated in the seating surface in the cap, when the stored vial is turned upside down.

Other objects, advantages and features of this invention will become more apparent from the following description.

SUMMARY OF THE INVENTION

In accordance with the principals of this invention, the above objects are accomplished by providing a vial for storing contact lenses, with the vial comprising a bottle and a closure, with the closure adapted to form a fluid-tight relationship with the bottle. A seating means is housed and formed within the closure, the seating means taking the form of a concave shape, the concavity substantially conforming to the concavity of the stored soft contact lens. The vial is stored upside down, and it has been found that the soft contact lens will migrate convex surface first so that the concave surface of the seating means will serve as a surface upon which the substantially similarly shaped soft contact lens will rest. Due to the capillary attraction, the soft lens will remain so seated, even when the vial is turned right-side up. At this point, the soft lens is retrieved from the vial by merely removing the closure, to which is adhered the soft contact lens.

DETAILED DESCRIPTION

Figure 1:
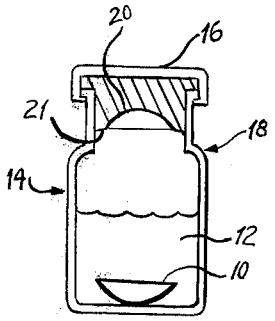
FIG. 1 is a side view showing the vial storing the contact lens in the normal fashion.

Referring to the drawings, there is shown in FIG. 1, a soft contact lens 10 stored in a solution 12 which is housed in a bottle 14. The bottle has a closure 16, which may take the form of a cap adapted to close the bottle and form the vial 18 of this invention in fluid-tight relationship. The contact lens 10 has a generally convex surface of a general spherical nature and the closure 16 has a seating means 20 housed therein. The seating means 20 also has a concave shape, with the shape of the concavity 20 substantially conforming with the shape of the lens 10. In the normal fashion, the concavity of the seating means 20 is directed oppositely to the bottom of the bottle, so that in the normal right-side up position, as shown in FIG. 1, the lens may be stored in the bottom of the vial. In this respect, FIG. 1 is similar to prior art devices, except for the difference in the construction of the cap and seating means, as will be explained in more detail hereinafter.

Figure 2:
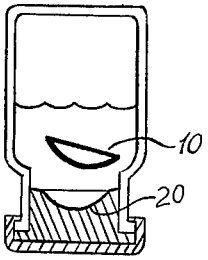
FIG. 2 is a view similar to FIG. 1 except that the vial is shown upside down.

FIG. 2 is a view similar to FIG. 1, except that the vial is turned upside down and the contact lens 10 is shown descending downwardly towards the seating means 20. It has been found that the contact lens 10 will descend downwardly convex surface first, so that as the contact lens 10 falls to the bottom of the upside-down vial, it seats and nests within seating surface 20. The conforming concave surface 20 of the seating means being substantially similar to the curvature of the lens serves to center the lens on the seating surface.

The present invention teaches that the vial is adapted to be stored in an upside down relationship with the cap serving as the bottom of the vial, although it is not necessary that the vial be stored upside-down always, it is only necessary that it be upside down for as long as it is required to allow the contact lens to descend to the bottom of the vial and seat in the seating means. It has been found that this takes at least 5 to 10 seconds, although a longer period may be required.

Figure 3:
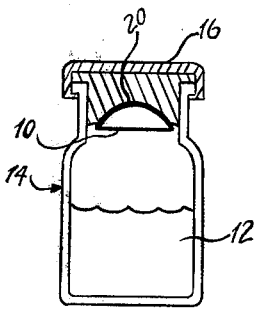
FIG. 3 is a view similar to FIGS. 1 and 2, with the vial of the present invention turned upside down and the contact lens adhering to the seating means of the cap of the vial.
Figure 4:
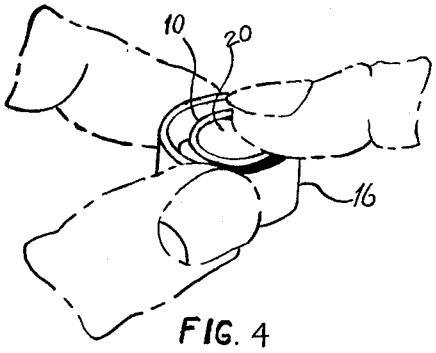
FIG. 4 is a view of the cap removed from the vial holding the soft contact lens.

FIG. 3 is a view of the vial similar to FIG. 1, except that the vial has now been turned right-side up after contact lens 10 adheres to the seating means 20. In this fashion, the contact lens will be out of immediate contact with the storage solution 12, and this will not deleteriously affect the soft contact lens. Thereafter, the closure or cap 16 is removed from the bottle 14, and the contact lens 10 adheres to the seating surface 20 of cap 16, so that as the cap is removed from the bottle, the contact lens is also removed. Then, the contact lens is merely taken from the cap as illustrated in FIG. 4, and may be inserted in the eye. The lens is removed from the cap by touching the ball of the finger to the concave surface of the seated lens which will enable the lens to adhere to the finger tip.

The capillary attraction between the seating means 20 and the contact lens is such as to allow the contact lens to be held securely thereto, as the cap is removed from the bottle. The substantially similarity between the conforming shapes of the seating surface 20 and contact lens 10 enhances the capillary attraction and centering action. Due to the amount of contacting surface area between these two elements, the capillary attraction is sufficient to enable the soft contact lens to be retained and held to the seating surface. The centering action prevents the lens from inadvertently adhering to the side wall of the bottle or being brushed off from the cap, when it is removed from the vial.

Figure 5:
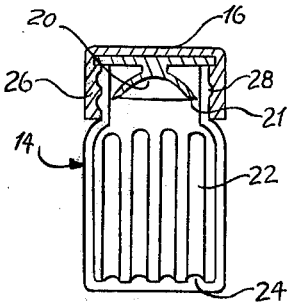
FIG. 5 is a view of another embodiment of this invention illustrating ribbed side and bottom surfaces for the bottle.

FIG. 5 illustrates another embodiment of this invention in which the bottle 14 is shown comprising ribbed sides 22 and a ribbed bottom 24, the ribbing being provided to minimize the possibility of a contact lens sticking to the sides or the bottom of the bottle when the vial is turned upside-down as in FIG. 2. By providing such a ribbed inner surface for the bottle, the capillary attraction between the soft lens and bottle is prevented.

FIG. 5 also illustrates a cap having a threaded section 26 for mating with complementary threads 28 on the bottle in order to provide a fluid tight relationship between the closure 16 and bottle 14 when the closure is screwed thereon.

It should be noted that the seating surface diameter formed in the closure is less than the diameter of the lens. A rim 21 is formed at the edge of the concave seating surface to prevent the soft contact lens from slipping into the separation between the edge of the seating surface and the side wall of the container. It has been found that 10 mm is a desirable width for the seating surface.

Additionally, the neck section of the bottle should have an opening at least as great as the diameter of the largest of the soft contact lenses to be stored in the present vial, so as to prevent any impairment of the ability of the contact lens to descend and be seated within seating means 20. As presently advised, the neck portion of the bottle should be approximately 16.0 mm.

Figure 6:
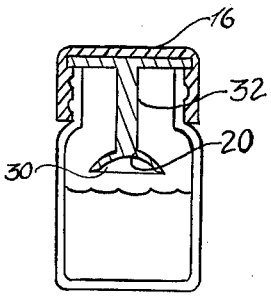
FIG. 6 is another embodiment of this invention.

FIG. 6 illustrates yet another embodiment of this invention in which the seating means 20 takes the form of a cup-like shape 30 attached to an extension number 32 which itself depends from and is attached to closure or cap 16. By extending the seating means or cup 30 from the cap 16, a soft contact lens applicator may be formed. In this regard, the reader is directed to applicant's prior U.S. Pat. No. 4,167,283 in which an apparatus for applying a soft contact lens is identified. The teachings of the prior patent are incorporated herein by reference, and the extension member 32 may correspond to stem 14, while seating surface 30 may correspond to cup section 16.

A finger attachment means may also be provided in the present invention so that the soft contact applicator of U.S. Pat. No. 4,167,283 may be approximated through the use of the present invention. The invention of FIG. 6 may be used by repeating the process illustrated in FIGS. 1 through 4, and removal of closure 16 will enable the contact lens 10 which adheres to seating surface 30 to be removed from the bottle when the closure is removed.

Although the present apparatus and method is set forth for a vial, the teachings are equally applicable to contact lens storage or carrying cases, and other modifications and changes from the teachings of the invention set forth herein may be constructed by those of ordinary skill in the art.

What is claimed is:

1. In combination, a soft-contact lens and a vial for storing said soft-contact lens permitting easy retrieval of the stored lens, said lens having a substantially spherical shape, said vial comprising a generally cylindrical bottle containing a solution in which said lens is stored at the bottom of said bottle, a closure adapted to close said bottle in fluid tight relationship, seating means provided in said closure, said seating means having a curvature substantially similar to the curvature of said lens, said seating means comprising a concave surface with the concavity facing to the bottom of the bottle, said concave surface substantially conforming to the shape of said soft-contact lens, said closure closing said bottle in said fluid-tight relationship, the closure and the bottom of said bottle being spaced apart by a distance greater than the diameter of said lens so that said bottle has a depth sufficient to permit said lens to descend from the bottom to said closure, convex surface first, to be seated on said seating means when said bottle is turned upside down, said lens adhering to said seating surface by capillary attraction when said vial is returned right-side up which enables the lens to be retrieved easily from said closure when removed from said bottle.

2. The combination of claim 1, wherein said closure comprises a cap having a flat top, said seating means being formed within said cap, the edge of said concave surface terminating short of the wall of said cap, and a rim extending from said edge of said concave surface to form a blocking surface within said cap preventing said lens from being trapped between the inner wall of the bottle and the edge of the seating means.

3. The combination of claim 2, wherein the diameter of said contact lens is greater than the width of said seating means.

4. The combination of claim 1, comprising an extension member attached to said closure, said extension member extending down into said bottle, said seating means attached to said extension member.

5. The combination of claim 1, wherein said bottle contains a neck section, the opening of said neck section being at least as large as the diameter of a contact lens to be stored in said vial.

6. The combination of claim 5, wherein said opening of said neck section is approximately 16.0 mm.

7. The combination of claim 4, wherein said seating means comprises a cup-like applicator structure sufficiently resilient to permit deflection of said seating means upon application of the lens to the eye, when the lens is held in said seating means.

8. The vial of claim 1, wherein said closure means comprises a threaded cap and said bottle comprises a threaded top neck, whereby said cap is screwed onto said bottle forming said fluid-tight closure.

9. The combination of claim 1, wherein said bottle comprises a ribbed bottom surface to minimize adherence of the lens to the bottom of the bottle.

10. The combination of claim 9, wherein the inner side walls of said bottle are ribbed to minimize adherence of the lens to the side of the bottle.

11. A vial for storing a soft-contact lens permitting easy retrieval of the stored lens, said lens having a substantially spherical shape, said vial comprising a generally cylindrical bottle containing a solution in which said lens is stored at the bottom of said bottle, a closure adapted to close said bottle in fluid tight relationship, seating means provided in said closure, said seating means having a curvature to accommodate the curvature of said lens, said seating means comprising a concave surface with the concavity facing the bottom of the bottle, said concave surface having a radius of curvature substantially equal to that of said soft-contact lens, said closure closing said bottle in said fluid-tight relationship, the closure and the bottom of said bottle being spaced apart by a distance greater than the diameter of said lens so that said bottle has a depth sufficient to permit said lens to descend from the bottom to said closure, convex surface first, to be seated on said seating means when said bottle is turned upside down, said lens adhering to said seating surface by capillary attraction when said bottle is returned right-side up which enables the lens to be retrieved easily from said closure when removed from said bottle.

* * * * *